US006710276B2

(12) United States Patent
Miyashita

(10) Patent No.: US 6,710,276 B2
(45) Date of Patent: Mar. 23, 2004

(54) KEYSWITCH FOR AN ELECTRONIC INSTRUMENT

(75) Inventor: Isao Miyashita, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 0 days.

(21) Appl. No.: 10/237,085

(22) Filed: Sep. 9, 2002

(65) Prior Publication Data

US 2003/0051986 A1 Mar. 20, 2003

(30) Foreign Application Priority Data

Sep. 14, 2001 (JP) ..... 2001-280833

(51) Int. Cl.[7] ..... H01H 5/18
(52) U.S. Cl. ..... 200/406; 200/512; 200/517
(58) Field of Search ..... 200/406, 5 A, 200/1 R, 67 DA, 513, 516, 517, 512

(56) References Cited

U.S. PATENT DOCUMENTS 3,996,429 A * 12/1976 Chu et al. ..... 200/5 A
3,996,547 A * 12/1976 Kinjo ..... 337/363
4,319,099 A 3/1982 Asher
4,768,284 A 9/1988 De Filippis et al.
4,913,285 A 4/1990 Tsutsumi et al.
4,933,522 A * 6/1990 Celander ..... 200/513
6,133,536 A * 10/2000 Hunag et al. ..... 200/5 A

FOREIGN PATENT DOCUMENTS

JP 2000-348566 12/2000

* cited by examiner

*Primary Examiner*—Lincoln Donovan
*Assistant Examiner*—K. Lee
(74) *Attorney, Agent, or Firm*—Dennison, Schultz, Dougherty & MacDonald

(57) ABSTRACT

A first fixed contact is mounted on an upper surface of a circuit substrate, and a second fixed contact is mounted on the upper surface of a circuit substrate around the first fixed contact. A movable contact having a semicircular sectional shape is mounted on the second fixed contact, and terminal electrodes are provided on an underside of the circuit substrate and connected to the first and second fixed contacts respectively. A spacer is mounted on the circuit substrate so as to surround the movable contact, and a cover is mounted on the spacer to cover the movable contact.

5 Claims, 6 Drawing Sheets

KEYSWITCH FOR AN ELECTRONIC INSTRUMENT

BACKGROUND OF THE INVENTION

The present invention relates to a contact device for a keyswitch used in an electronic instrument such as portable telephone, and more particularly relates to a contact device in a key sheet module used in a keyswitch operated by a key top.

FIG. 10 is a plan view showing a conventional key sheet module, FIG. 11 is an enlarged sectional view taken along a line XI—XI of FIG. 10, and FIG. 12 is a plan view of fixed contacts.

The key sheet module 81 comprises a substrate 82, and a plurality of keyswitches 83 provided on the substrate 82.

Referring to FIGS. 11 and 12, the keyswitch 83 comprises a first circular fixed contact 86 secured on the substrate 82, and a second annular fixed contact 87 provided around the first fixed contact 86, and a movable contact 85 having a semispherical shape and mounted on the second fixed contact 87. The first fixed contact 86 is connected to a circuit pattern 88 provided on the underside of the substrate 82 by a connecting pipe 82*a* secured to a wall of a through-hole formed in the substrate 82. The second fixed contact 87 is connected to a circuit pattern 89 provided on the upper surface of the substrate 82. An adhesive sheet 84 is adhered to the substrate 82 to hold the movable contact 85 each of the keyswitches 83.

When the movable contact 85 is pressed by a key (not shown), the contact 85 contacts with the first fixed contact 86. Thus, the first and second fixed contacts 86 and 87 are connected with each other.

In the conventional keyswitch, since circuit patterns 88 and 89 are provided on both surfaces of the substrate 82, the manufacturing cost increases. Further, there are two different manufacturing steps comprising the soldering on the circuit patterns 88 and 89 and the adhering of the adhesive sheet 84, which increases further the manufacturing cost.

SUMMARY OF THE INVENTION

An object of the present invention is to provide a contact device which may be manufactured at a low cost.

According to the present invention, there is provided a keyswitch comprising a circuit substrate, a first fixed contact mounted on an upper surface of the circuit substrate, a second fixed contact mounted on the upper surface of the circuit substrate around the first fixed contact, a movable contact having a semicircular sectional shape and mounted on the second fixed contact, terminal electrodes provided on an underside of the circuit substrate and connected to the first and second fixed contacts respectively, a spacer mounted on the circuit substrate so as to surround the movable contact, and a cover mounted on the spacer to cover the movable contact.

The movable contact has a plurality of feet so as to hold the movable contact, and the second fixed contact has an opening. The first fixed contact is connected to the terminal electrode by a conductive pattern formed on the circuit substrate in the opening.

These and other objects and features of the present invention will become more apparent from the following detailed description with reference to the accompanying drawings.

DETAILED DESCRIPTION OF THE PREFERRED EMBODIMENT

Figure 1:
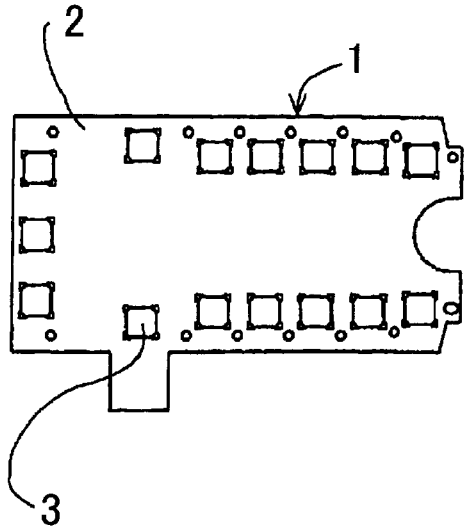
FIG. 1 is a plan view showing a key sheet module for a present invention.
Figure 2:
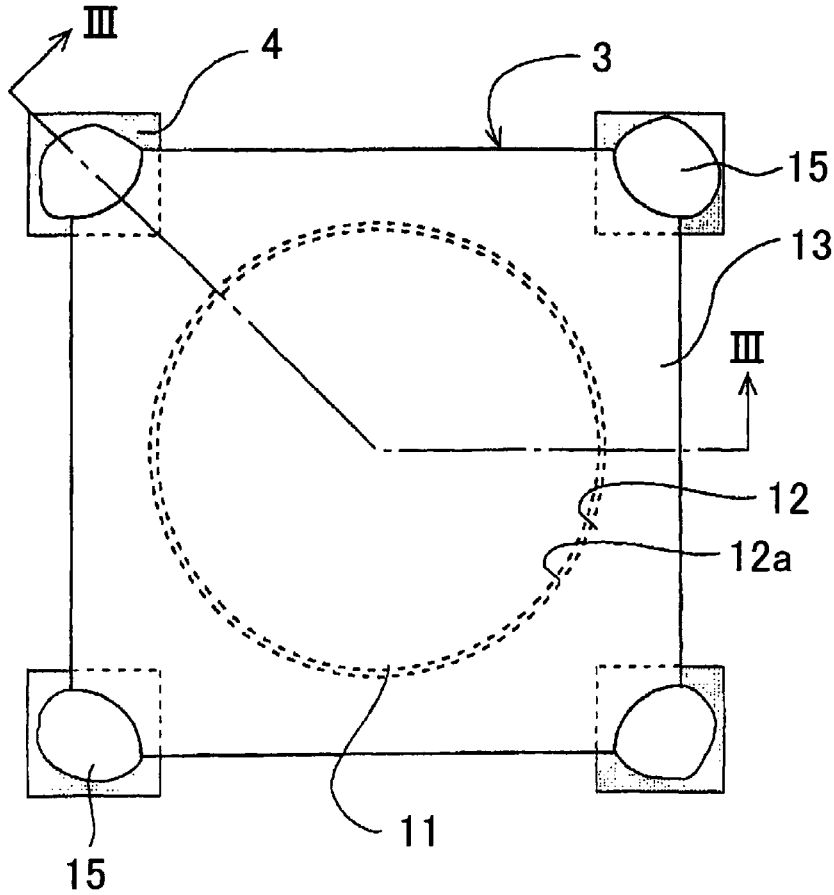
FIG. 2 is a plan view of a keyswitch of the present invention.
Figure 3:
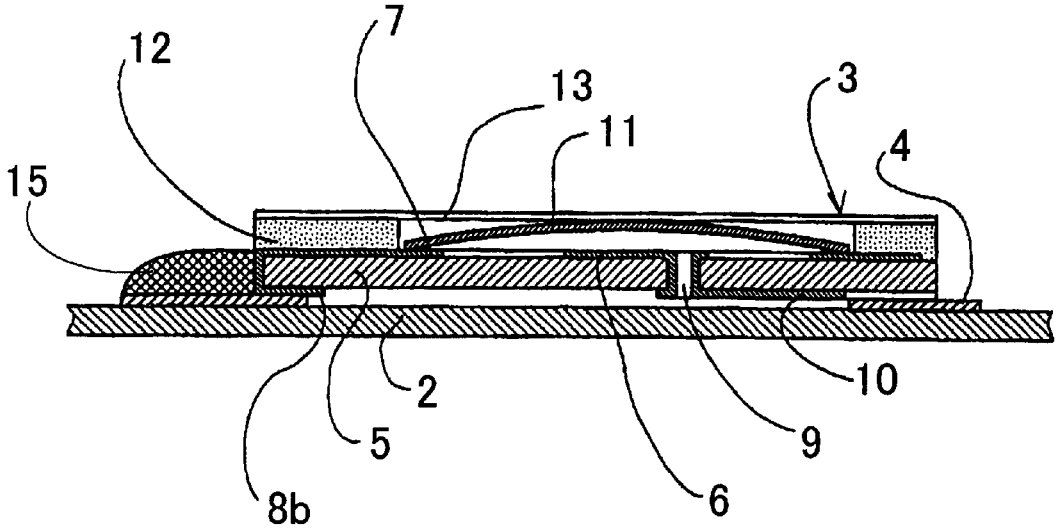
FIG. 3 is a sectional view taken along a line III—III of FIG. 2.
Figure 4:
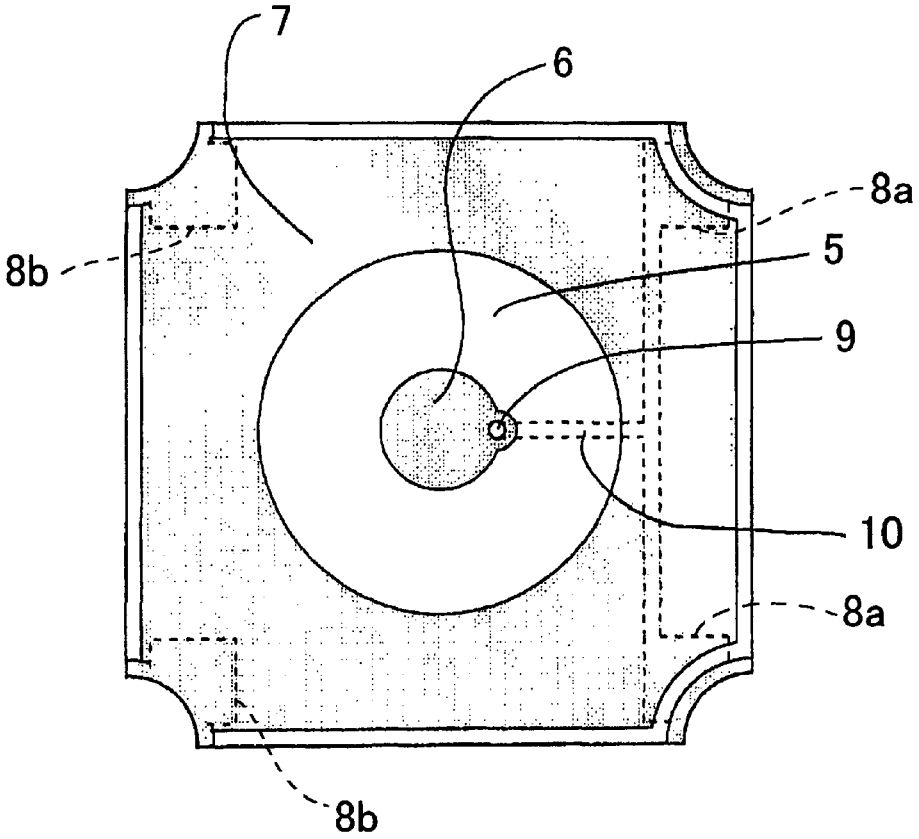
FIG. 4 is a plan view of fixed contacts.
Figure 5:
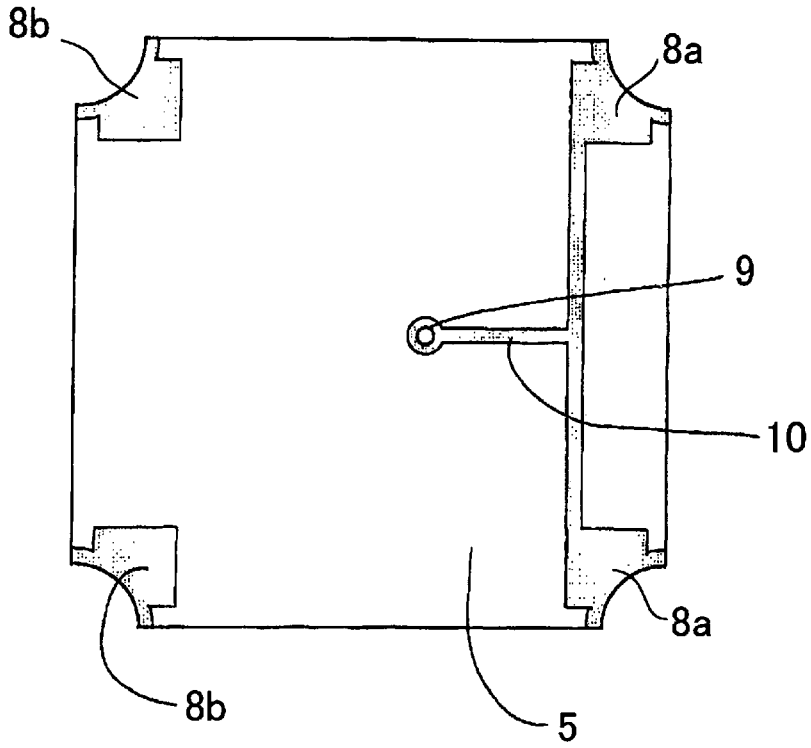
FIG. 5 shows the underside of the keyswitch.

FIG. 1 is a plan view showing a key sheet module for a present invention, FIG. 2 is a plan view of a keyswitch of the present invention, FIG. 3 is a sectional view taken along a line III—III of FIG. 2, and FIG. 4 is a plan view of fixed contacts.

The key sheet module 1 comprises a substrate 2, and a plurality of keyswitches 3 provided on the substrate 2.

Referring to FIGS. 2 and 3, the keyswitch 3 comprises a circuit substrate 5, a first circular fixed contact 6 secured on the circuit substrate 5 and a second fixed contact 7 provided around the first fixed contact 6, and a movable contact 11 having a semispherical shape and mounted on the second fixed contact 7. The first fixed contact 6 is connected to a conductive pattern 10 provided on the underside of the substrate 5 by a connecting pipe 9 secured to a wall of a through-hole formed in the substrate 5.

The conductive pattern 10 is connected to terminal electrodes 8*a* provided at two corners of the circuit substrate 5 as shown in FIG. 4. The second fixed contact 7 is connected to terminal electrodes 8*b* provided on the underside of the circuit substrate 5 at other two corners.

The movable contact 11 is held by an annular spacer 12 secured to the upper surface of the circuit substrate 5. The spacer 12 has a thickness approximately equal to the height of the movable contact 11, and a cover 13 is secured on the spacer 12 to be contact with the surface of the movable contact 11.

The circuit substrate 5 is mounted on the substrate 2 so that the terminal electrodes 8*a* and 8*b* are in contact with circuit patterns 4 on the substrate 2 and secured to the circuit patterns 4 by solders 15.

When the movable contact 11 is pressed by a key (not shown), the contact 11 contacts with the first fixed contact 6. Thus, the first and second fixed contacts 6 and 7 are connected with each other.

Figure 6:
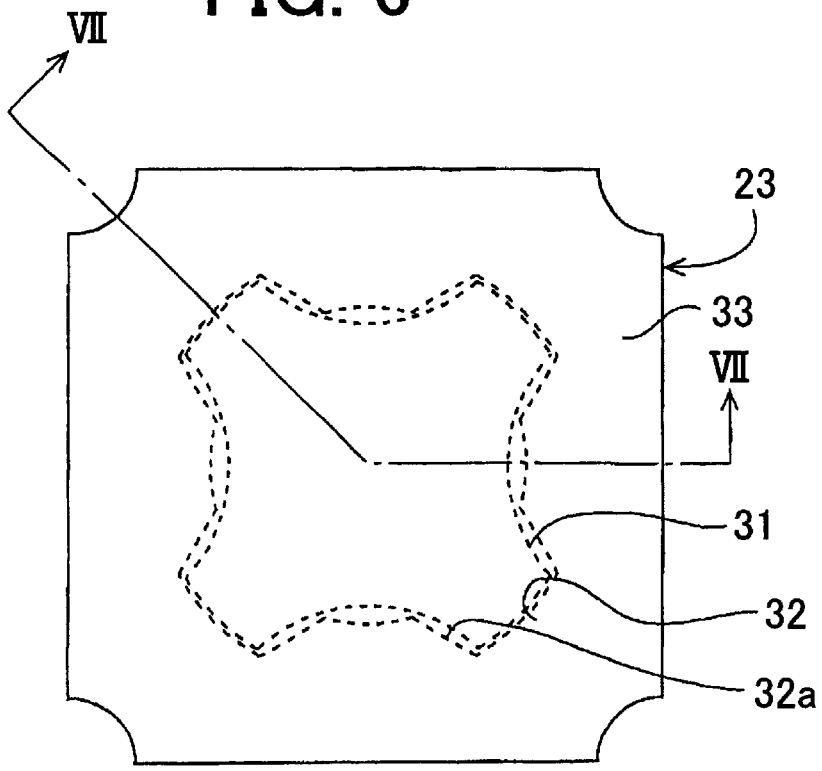
FIG. 6 is a plan view of a second embodiment of the present invention.
Figure 7:
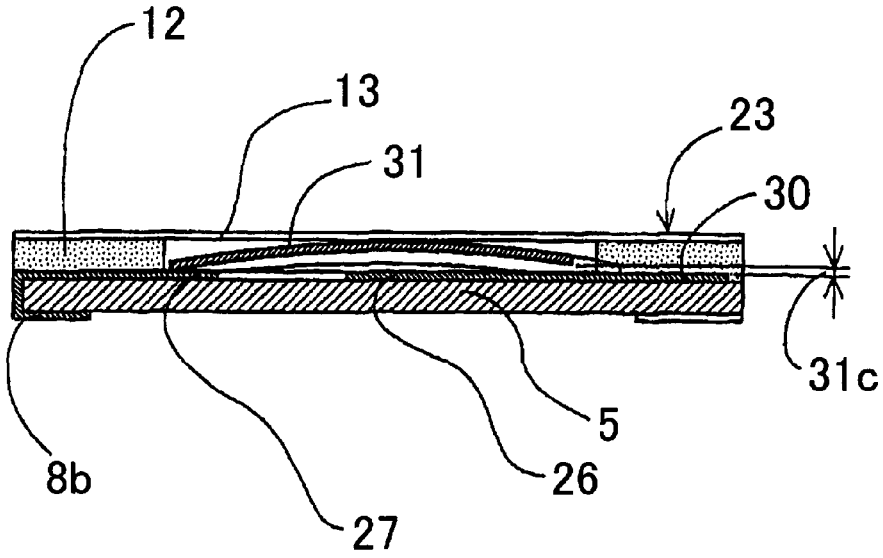
FIG. 7 is a sectional view taken along a line VII—VII of FIG. 6.

FIG. 6 is a plan view of a second embodiment of the present invention, FIG. 7 is a sectional view taken along a line VII—VII of FIG. 6.

Figure 8:
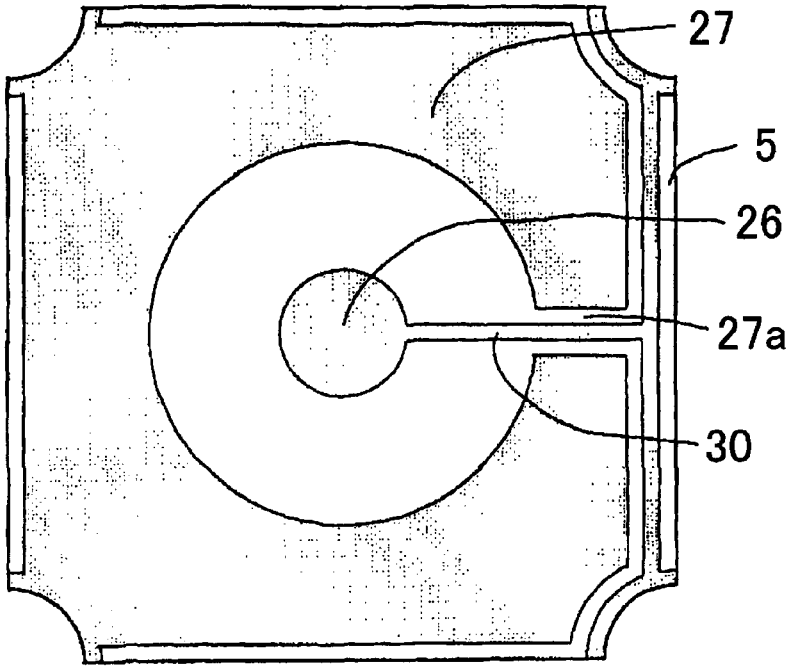
FIG. 8 is a plan view of fixed contacts.
Figure 9:
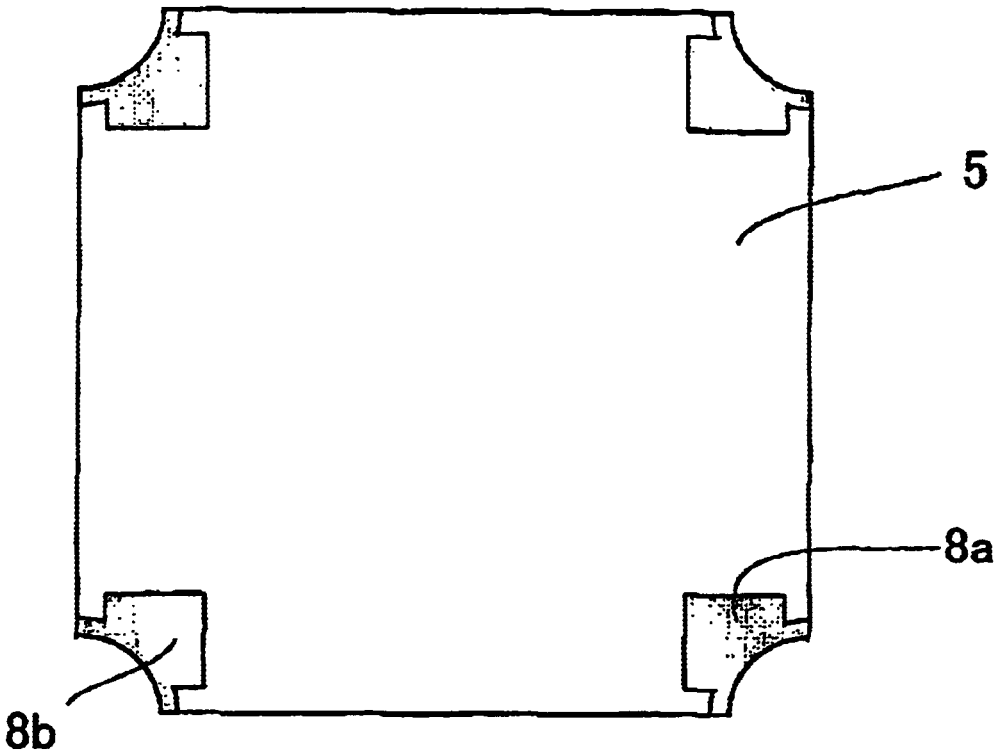
FIG. 9 shows the underside of the keyswitch.
Figure 10:
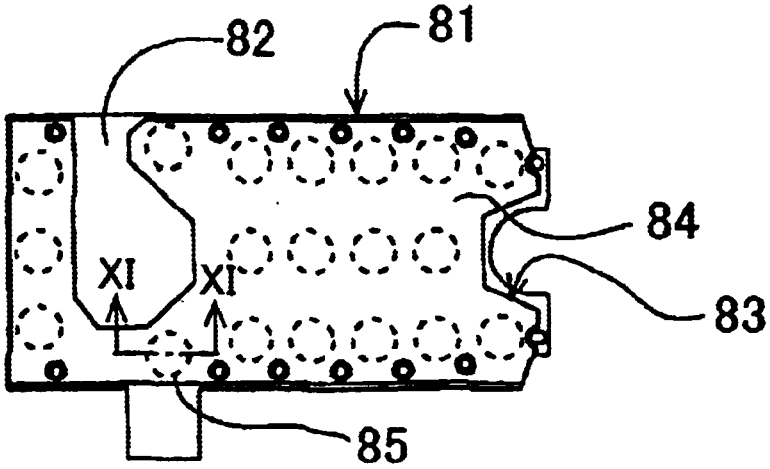
FIG. 10 PRIOR ART
FIG. 10 is a plan view showing a conventional key sheet module.
Figure 11:
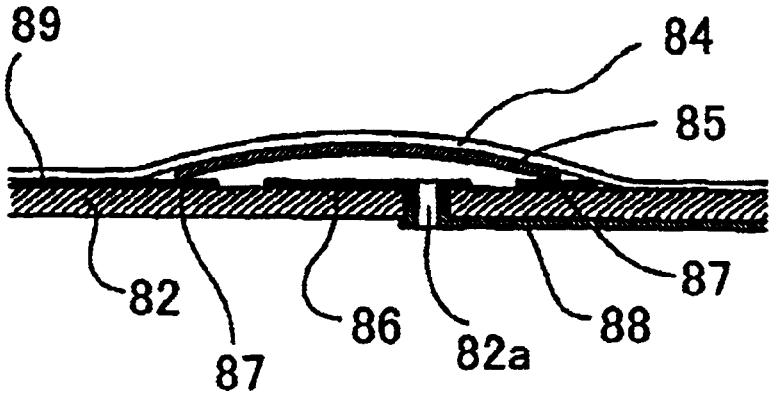
FIG. 11 PRIOR ART
FIG. 11 is an enlarged sectional view taken along a line XI—XI of FIG. 10.
Figure 12:
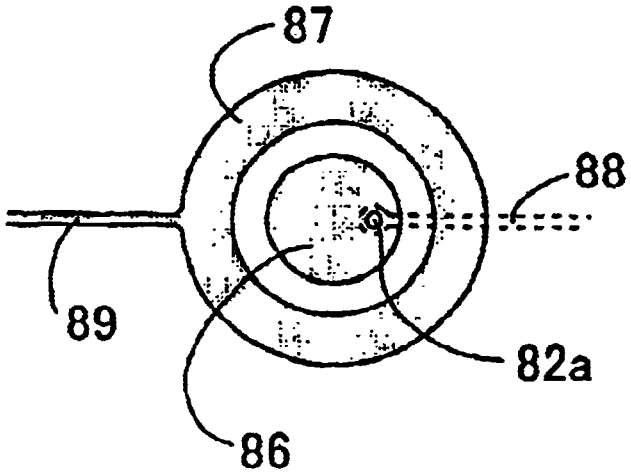
FIG. 12 PRIOR ART
FIG. 12 is a plan view of fixed contacts.

A keyswitch 23 comprises a first fixed contact 26, a second fixed contact 27, and a movable contact 31. The movable contact 31 has four feet to form a cross. Accordingly, a spacer 32 has a cross hole 32*a* so as to hold the movable contact 31. As shown in FIG. 8, the second fixed contact 27 has an opening 27*a* at a position between feet of the movable contact 31. A conductive pattern 30 of the first fixed contact 26 is connected to the terminal electrodes 8*a* passing through the opening 27*a*. The movable contact 31 has a gap 31*c* between the feet so as not to contact with conductive pattern 30 and the second fixed contact 27.

Other parts are the same as the first embodiment and identified with the same reference numeral so that explanation thereof is omitted.

In accordance with the present invention, first and second fixed contacts provided on the upper surface of the circuit substrate are connected to terminal electrode provided on the underside of the circuit substrate. Therefore, a substrate on which the circuit substrate is mounted may provide a circuit pattern on only an upper surface.

Furthermore, adhesive manufacturing process is obviated. Thus, manufacturing cost can be largely reduced.

While the invention has been described in conjunction with preferred specific embodiment thereof, it will be understood that this description is intended to illustrate and not limit the scope of the invention, which is defined by the following claims.

What is claimed is:

1. A keyswitch comprising:

a circuit substrate having a square shape in plan view;

a first fixed contact mounted on an upper surface of the circuit substrate;

a second fixed contact mounted on the upper surface of the circuit substrate around the first fixed contact;

a movable contact having a semicircular sectional shape and mounted on the second fixed contact;

a spacer mounted on the circuit substrate so as to surround the movable contact;

a cover mounted on the spacer to cover the movable contact;

a pair of terminal electrodes provided on an underside of the circuit substrate at two portions of the circuit substrate;

connecting means for connecting the first fixed contact and the second fixed contact with the terminal electrodes respectively; and each of the terminal electrodes having a flat underside surface so as to be contacted with circuit patterns provided on a substrate of an instrument when the circuit substrate is mounted on the substrate.

2. The keyswitch according to claim 1 wherein the connecting means for the first fixed contact comprises a connecting pipe passing through the circuit substrate from the first fixed contact to the underside of the circuit substrate, and a conductive pattern connecting a lower end of the connecting pipe with one of the terminal electrodes, and the connecting means for second fixed contact comprises a connecting plate connecting the second fixed contact with the other terminal electrode passing an outside wall of the circuit substrate.

3. The key switch according to the claim 2 wherein the connecting means for the first fixed contact comprises an opening formed in the second fixed contact for communicating an inside area and an outside area of the second fixed contact, a conductive pattern connecting the first fixed contact with the terminal electrode, passing through the opening at a position between the feet.

4. The keyswitch according to the claim 1 wherein the movable contact has a semispherical shape.

5. The keyswitch according to claim 1 wherein the movable contact has a plurality of feet mounted on the second fixed contact.

* * * * *